United States Patent [19]

Richardson

[11] 4,262,772

[45] Apr. 21, 1981

[54] ENCLOSED CHUTE FIRE ESCAPE

[76] Inventor: Hermine Richardson, 32 Clifford Rd., Menands, N.Y. 12204

[21] Appl. No.: 104,115

[22] Filed: Dec. 17, 1979

[51] Int. Cl.[3] ..... A62B 1/20

[52] U.S. Cl. ..... 182/48; 182/113

[58] Field of Search ..... 182/48, 49, 113, 106; 193/2 R, 32

[56] References Cited

U.S. PATENT DOCUMENTS

| | | | |
|---|---|---|---|
| 876,893 | 1/1908 | Arnold | 182/48 |
| 952,239 | 3/1910 | Davidson | 182/48 |
| 2,101,284 | 12/1937 | Simpson | 182/48 |

FOREIGN PATENT DOCUMENTS

| | | | |
|---|---|---|---|
| 2441887 | 11/1976 | Fed. Rep. of Germany | 182/48 |

*Primary Examiner*—Reinaldo P. Machado

[57] ABSTRACT

Discloses an enclosed chute fire escape, elongated and of rectangular configuration, having a bottom, side walls and a top. The side walls carry support brackets which have depending legs which carry and dispose handle rails parallel to the bottom. Access portals formed through the side walls provide access to platforms carried by the side walls coplanar with the horizontal building plane of the building. Vertical grip rails are disposed and carried between and by the top of the chute and the handle rails.

7 Claims, 2 Drawing Figures

ENCLOSED CHUTE FIRE ESCAPE

BRIEF SUMMARY OF THE INVENTION

This invention relates to the field of fire escapes. The object of this is to provide an enclosed chute fire escape for use, in the event of fire, in the safe, controlled and rapid exit of persons from the burning structure without exposure to flames, heat or smoke.

BRIEF DESCRIPTION OF THE DRAWING

This object and other objects of the invention should be discerned and appreciated by reference to the detailed description taken in conjunction with the drawing, wherein like reference numerals refer to similar parts throughout the several views, in which.

DETAILED DESCRIPTION

Figure 1:
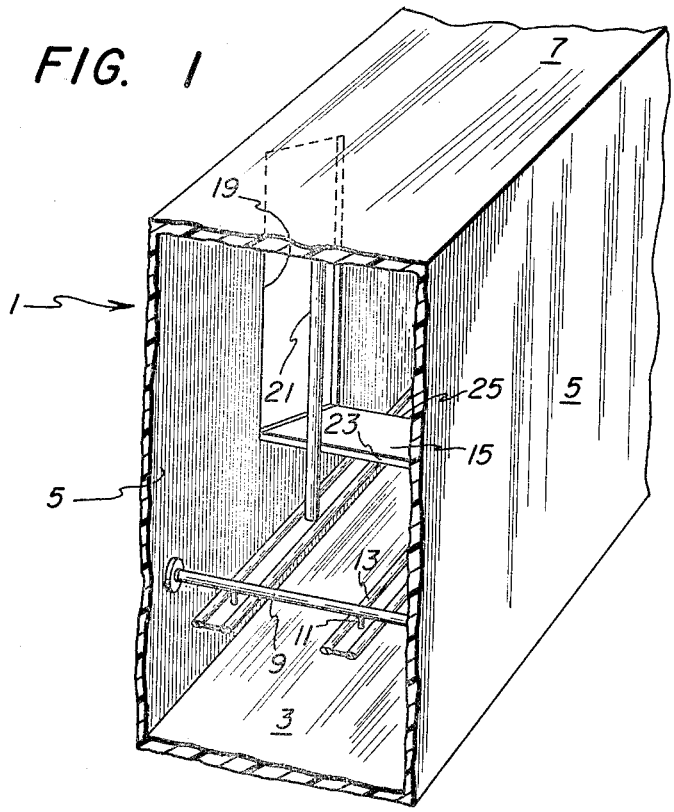
FIG. 1 is a perspective view of a portion of the enclosed chute fire escape of this invention; and, FIG. 2 is a perspective view of the invention disposed for operative use in a three-story building shown in phantom lines.

In FIG. 1 of the drawing, reference numeral 1 generally refers to the enclosed chute fire escape of this invention. Elongated chute 1 is of rectangular configuration and has a bottom 3, side walls 5 and top 7. Disposed between side walls 5 and suitably carried in fixed relationship therewith are handle-rail support brackets 9. Suitably fixed to and depending from support brackets 9 are legs 11 which are suitably fixed to and carry handle rails 13. The handle rails 13, uniquely configured as shown, are longitudinally disposed relative to elongated chute 1.

Disposed between side walls 5 and suitably carried in fixed relationship therewith are platforms 15. Each of the platforms 15 is disposed coplanar with the imaginary horizontal plane of the buidling structure, generally referred to by reference numeral 17. Suitable access portals 19 are formed in either or both of the side walls 5 where needed to provide access to their respective platforms 15. Of course, such access portals 19 would be suitably closed by emergency exit doors (not shown) or the like from the building structure 17 itself in order that emergency access to such platforms 15 can be gained through such access portals 19 by opening and thereafter closing such emergency exit doors to thereby prevent or minimize any exposure to flames, heat or smoke from the burning building or from same entering chute 1. Suitably fixed to and upstanding from handle rails 13 are vertically disposed grip rails 21 which are suitably fixed to the top 7 of chute 1. Each of the platforms 15 has a leading edge 23 and a trailing edge 25. The handle rails 13 are disposed parallel with the bottom of chute 1 and approximately 22 inches from the bottom 3 of such chute 1. The platform 15 is suitably disposed such that its trailing edge 25 is approximately 30 inches from the bottom 3 of chute 1.

Figure 2:
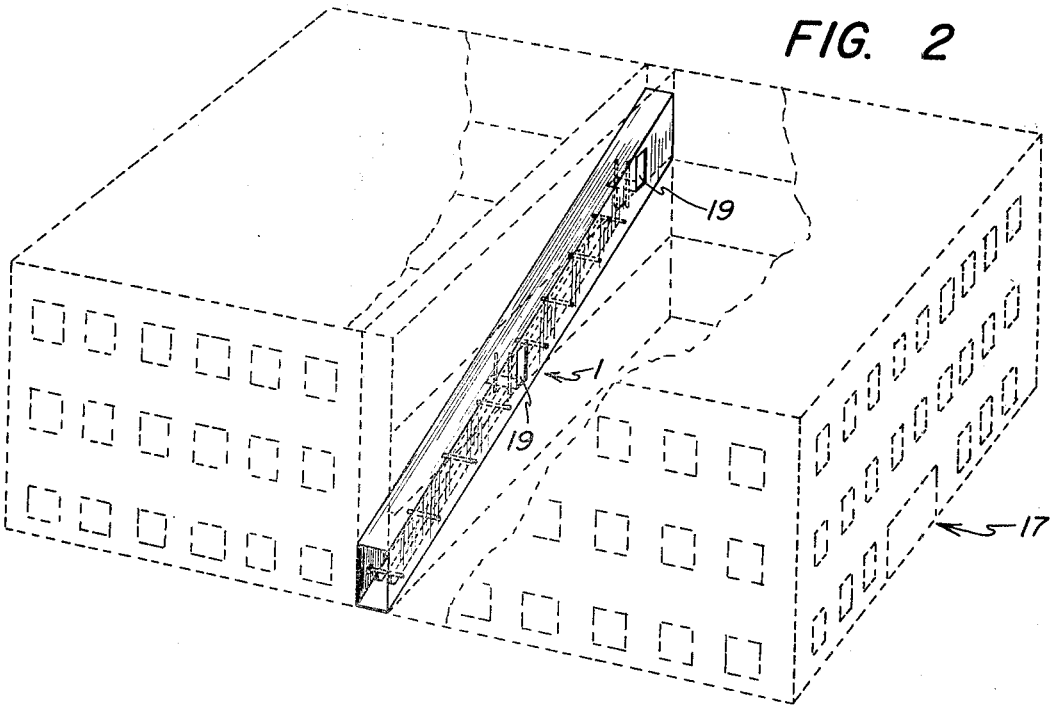

In FIG. 2, the chute 1 is shown disposed in inclined relationship in a three-story building structure 17. Access portals 19 and corresponding platforms 15 are provided on the second and third floors where needed depnding upon the number of persons who may utilize the enclosed chute fire escape 1 in the event of a fire.

In utilizing the enclosed chute fire escape 1 for exit from a burning building, a person would open the nearest emergency exit door on his floor, enter through the corresponding access portal 19 onto platform 15 and close such emergency exit door. Then he would suitably grasp the vertical grip rail 21 and lower himself from the leading edge 23 of platform 15 in such manner that his feet touch the bottom 3 of chute 1. Then such person would so position his body that his back is lying on the bottom 3 of chute 1 and his hands are grasping a handle rail 13 preparatory to feet-first descent down chute 1. He then releases his grasp upon handle rail 13 to the extent necessary to allow gravity descent of his body down the bottom 3 of chute 1 while at the same time maintaining light hand contact with handle rail 13 to guide his body upon bottom 3 of and down chute 1, and also to be in a position to slow or stop his descent which will depend upon the magnitude of grasping force his hands apply to such handle rail 13.

Shown in the drawing is a chute 1 in which two separate handle rails 13 are disposed. Of course, only one handle rail 13 could be utilized; in which case, the width between the side walls 5 would be proportionately less. Also, more than two handle rails 13 could be utilized; in which case, the width between the side walls 5 would be proportionately greater. Whether one handle rail 13 is, or two or more handle rails 13 are, utilised would depend upon the number of persons who would make use of chute 1 in the event of a fire. Multiple handle rails 13 permit a correspondingly greater number of persons to use the fire escape 1 at the same time. Inasmuch as each handle rail 13 is centrally disposed relative to a person's body throughout such person's descent down the chute 1, it is physically far easier for a person to grasp with both hands a handle rail 13 that is centrally aligned with his body than to extend his arms laterally outward to grasp a rail or rails. Such central disposition and alignment of a handle rail 13 allows a person to exert more physical control in guiding, slowing or stopping his descent down the bottom 3 of chute 1. Of particular significance is the fact that there are no mounting means, such as brackets or the like, which at any time will physically interfere with such person or his hands in guiding, slowing or stopping his descent down chute 1.

A corresponding number of chutes, inclined at the same angle as the chute 1 shown in FIG. 2, would be employed serpentine-fashion but in alternating disposition for a multi-story building similar to building structure 17 having more than three floors. In such case, and depending upon the number of floors, the first chute would be disposed as chute 1 is disposed in FIG. 2, the second chute would be inclined at the same angle as is chute 1 shown in FIG. 2 but in the opposite direction. The third chute would again be disposed the same as chute 1 is disposed in FIG. 2, etc.

Having thusly described my invention, I claim:

1. An enclosed chute fire escape for use, in the event of a fire, in the safe, controlled and rapid exit of persons from the building structure with which said fire escape is employed without exposure to flames, heat or smoke, said fire escape comprising an elongated chute, support brackets, depending legs and handle rails, said chute having side walls carrying said support brackets therebetween, said support brackets carrying said depending legs, said depending legs carrying said handle rails, said handle rails being disposed throughout the length of said chute, each of said handle rails being centrally disposed relative to a person's body with said person descending said chute on his back, said depending legs carrying and mounting said handle rails for non-interfering engagement physically by a person's hands in guiding his body, or slowing or stopping same, in descent on his back down said chute.

2. An enclosed chute fire escape in accordance with claim 1, wherein said chute has a bottom and wherein said handle rails are parallel with said bottom of said chute.

3. An enclosed chute fire escape in accordance with claim 1, wherein said chute has access portals and platforms, wherein said access portals provide access to the interior of said chute and said platforms, and wherein said chute carries said platforms.

4. An enclosed chute fire escape in accordance with claim 1, wherein said chute has access portals, platforms and grip rails, wherein said access portals provide access to the interior of said chute and to said platforms, wherein said chute carries said platforms, wherein said chute and said handle rails carry said grip rails.

5. An enclosed chute fire escape in accordance with claim 1, wherein said chute has access portals, platforms and grip rails, wherein said access portals provide access to the interior of said chute and to said platforms, wherein said chute carries said platforms, wherein said chute and said handle rails carry said grip rails.

6. An enclosed chute fire escape in accordance with claim 5, wherein said chute has a top, wherein said chute top and said handle rails carry said grip rails and wherein said grip rails are vertically disposed.

7. An enclosed chute fire escape in accordance with claim 6, wherein said building structure has an imaginary horizontal plane and wherein said platforms are coplanar with such horizontal plane of said building structure.

* * * * *